US006014829A

United States Patent [19]

Wilson et al.

[11] Patent Number: 6,014,829

[45] Date of Patent: Jan. 18, 2000

[54] LIGHT BOX FOR COUNTER OR WALL DISPLAY

[75] Inventors: Nick Wilson, Flossmoor; Frank Thibideau, East Hazelcrest, both of Ill.

[73] Assignee: Morrison Timing Screw Company, Glenwood, Ill.

[21] Appl. No.: 09/250,586

[22] Filed: Feb. 16, 1999

[51] Int. Cl.[7] ..... G09F 1/10; A47G 1/14

[52] U.S. Cl. ..... 40/753; 40/716; 248/688

[58] Field of Search ..... 40/716, 753, 748, 40/564; 248/688, 351, 222.51, 291.1, 447, 462

[56] References Cited

U.S. PATENT DOCUMENTS

| | | | |
|---|---|---|---|
| 1,225,195 | 5/1917 | Wanda . | |
| 2,072,167 | 3/1937 | Graham . | |
| 2,456,720 | 12/1948 | Miles | 40/747 |
| 2,756,529 | 7/1956 | Mazzocco . | |
| 3,041,763 | 7/1962 | Knox . | |
| 3,686,894 | 8/1972 | Handler et al. . | |
| 5,329,712 | 7/1994 | Keller . | |

FOREIGN PATENT DOCUMENTS

| | | | |
|---|---|---|---|
| 816880 | 7/1959 | United Kingdom | 40/716 |
| 1190012 | 4/1970 | United Kingdom | 40/716 |
| WO 92/3956 | 3/1992 | WIPO | 40/748 |

OTHER PUBLICATIONS

*Dick Blick Art Materials 1998* catalog, p. 51, the "Dick Blick Light Box" (No. H986100).

*Dick Blick Art Materials Back to School* catalog, p. 421, "Light Tables & Boxes" (All on that page).

*Primary Examiner*—Cassandra H. Davis
*Attorney, Agent, or Firm*—Richard G. Kinney

[57] ABSTRACT

A light box having a pair of retractable flat legs that fit into shallow depressions in the rear surface of the housing for the light box and are pivotable from a storage position wherein they are substantially entirely within the depression and a functional position wherein they project out from the housing and can serve to help support the light box on a flat surface with its translucent surface exposed to the side. The legs, when in the functional position, are helped to be held in place by close fitting adjacent edge wells of the depression and are resiliently bendable so as to be able to be moved between the storage and active positions by being flexibly bent outward by the user and rotated over the non-depression or raised portions of the rear surface and yet snap back into either depressed position.

7 Claims, 4 Drawing Sheets

LIGHT BOX FOR COUNTER OR WALL DISPLAY

FIELD OF THE INVENTION

The present invention is directed to an improved light box that may be displayed on a counter, hung on a wall, or laid flat on a table or like surface and may be used for displaying a message or image on its translucent surface or for tracing or editing work by a draftsman or artist.

BACKGROUND OF THE INVENTION

Light boxes of various designs have been suggested for use as displays. For example, the light box depicted in U.S. Pat. No. 2,756,529. Other light boxes have been used by medical practitioners, artists and draftsman in their work or as an aid in reading x-rays or other similar transparent images. Commercial light boxes of various designs are offered on page 421 of the 1998 *Dick Blick Art Materials* catalog and on page 51 of the *Dick Blick Art Materials* D-C catalog.

Such light boxes, while useful, are somewhat lacking in versatility in that, for example, the device of U.S. Pat. No. 2,756,529 may rest on a counter or table and present its rectangular translucent surface vertically in a portrait format, it can not do so in a vertical landscape format, or easily hang from a wall in either format or be used flat on a table by an artist or a draftsman.

Other patent documents of possible interest, although not specific to light boxes, are U.S. Pat. Nos. 5,329,712; 3,686,894; 3,041,763; 2,072,167; and 1,225,195.

SUMMARY OF THE INVENTION

A light box constructed in accordance with the principles of the present invention, including a rear generally planar housing wall that defines a shallow depression on its other side and at least one resiliently bendable flat leg member that is pivotally mounted to the rear wall so as to move from a storage position substantially entirely within said depression and a functional position wherein the leg projects outward from the housing and serves to aid in holding the light box with its translucent surface visible to the side on a flat surface.

DETAILED DESCRIPTION OF THE PREFERRED EMBODIMENTS

Figure 1:
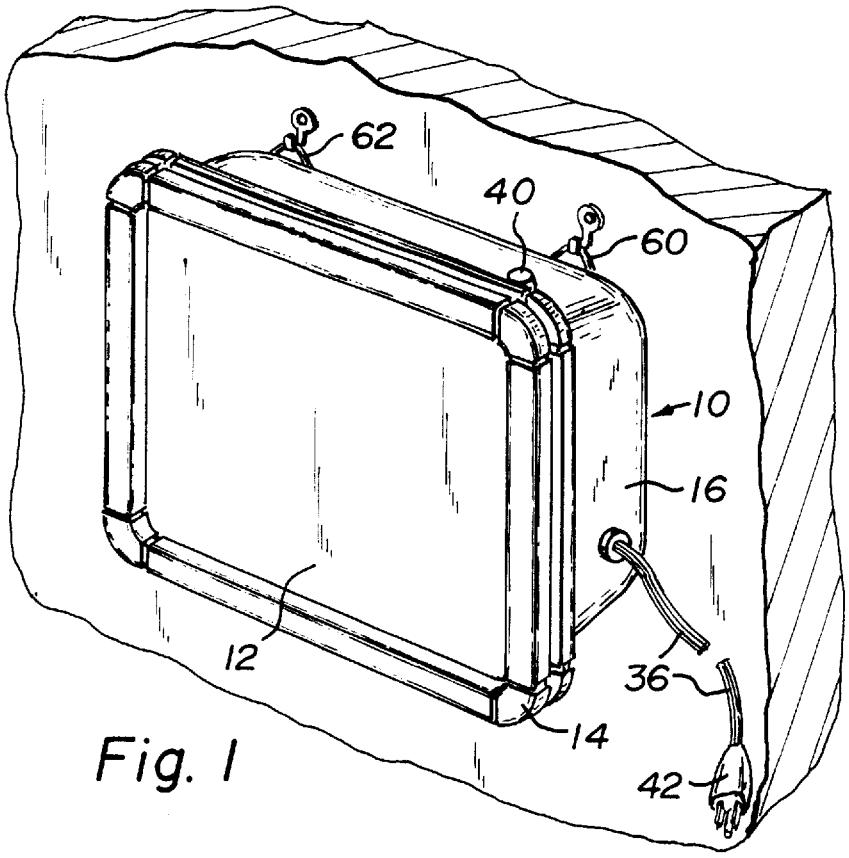
FIG. 1 is a perspective front view of a light box constructed in accordance with the present invention shown hanging from a wall.
Figure 2:
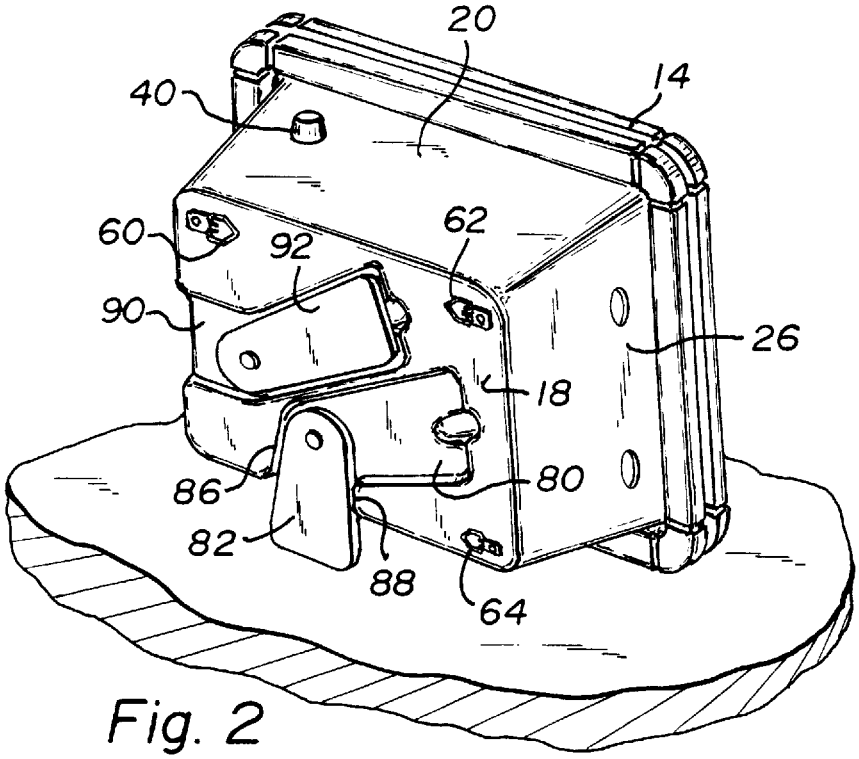
FIG. 2 is a perspective rear view of the light box of FIG. 1 shown resting on a flat surface with its lighted surface displayed to the side in the landscape orientation.
Figure 4:
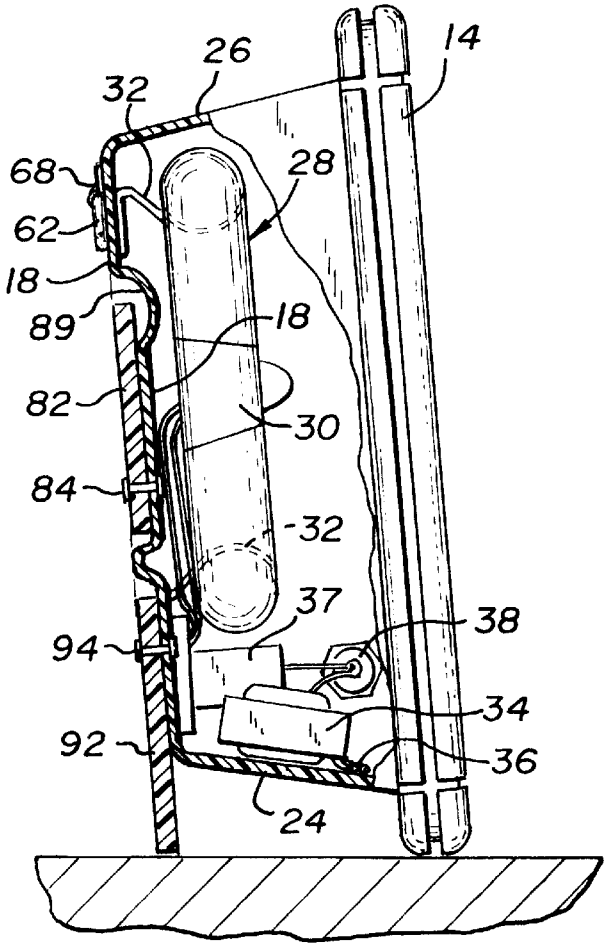
FIG. 4 is a side view of the light box of FIGS. 1–3, with its legs orientated as shown in FIG. 3, positioned on a flat surface with its lighted surface displayed to the side in the portrait orientation, which view is partially in sections generally taken along the line 4—4 of FIG. 3 to show its interior construction.
Figure 3:
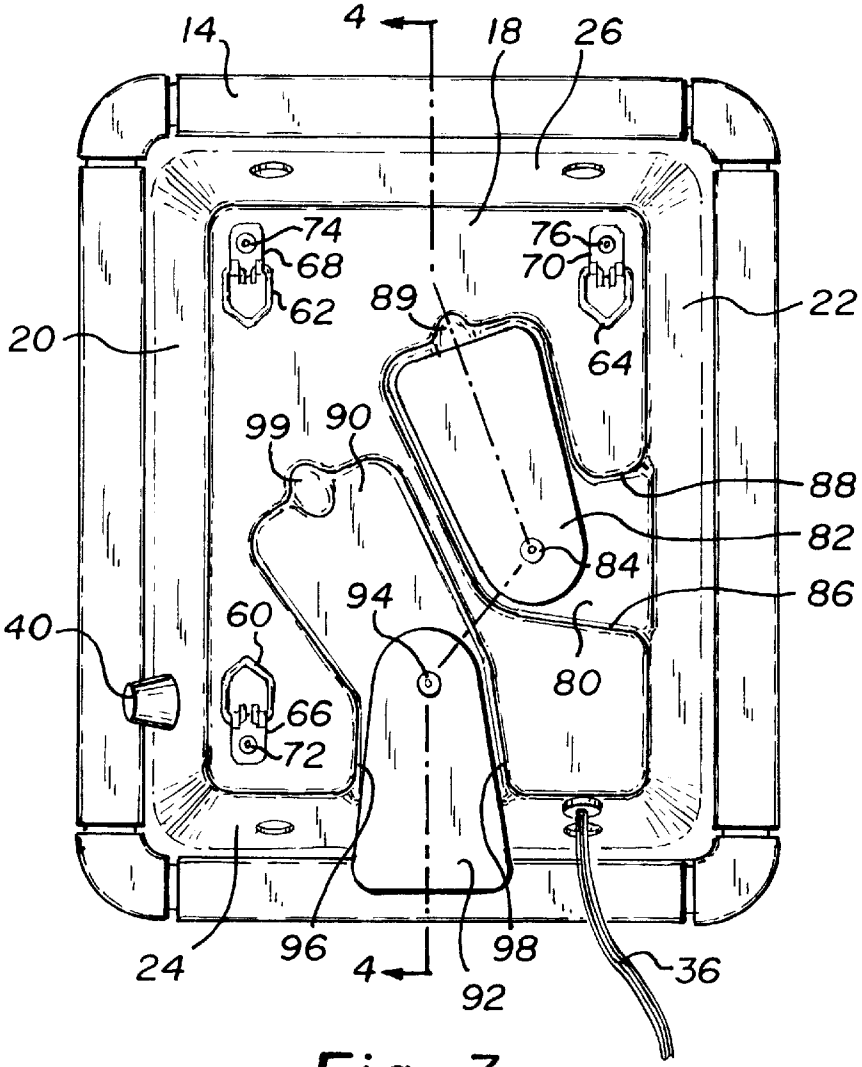
FIG. 3 is a rear view of the light box of FIGS. 1–2 with two parts, support legs, in moved positions from their positions of FIG. 2.

Referring now to the figures, and initially to FIG. 1, there is depicted a light box 10 constructed in accordance with the principles of the present invention. The light box 10 has a rectangular translucent planar member 12 surrounded by a frame 14. A rear unitary housing 16 encloses a fluorescent lamp (better shown in FIG. 4). The housing 16 is formed with a rear wall 18 (FIG. 2) of a generally rectangular shape but of slightly reduced dimensions from that of the translucent planar member 12 or its frame 14. A top wall 20 extends from the top edge of the rear wall 18 of the housing 16 and similar bottom wall 22 left, side wall 24 and right side wall 26 are provided. These walls 20, 22, 24 and 26 all project outward to meet the frame 14 and, together with the rear wall 18, form a generally tray-like structure, as best seen in FIGS. 3 and 4.

Inside the light box 10 is an electric lamp 28, which includes a circular compact florescent tube 30 releasibly secured by clips 32 which are secured to the back wall 18. The lamp 28 includes a transformer 34 secured to the back wall 18 near the bottom side wall 24, and a starter 37 is also secured to the back wall 18 adjacent to the transformer. An electrical cord 36 for connecting electricity from the mains to the lamp 28 is provided as well as an on-off switch 38, secured through the top wall 20 and operated by an external knob 40 (FIGS. 1, 2 and 3). Interconnecting wires (only some of which are shown for ease and clarity of depiction) are also included. As the lamp 28 may be entirely conventional these need not be further disclosed here.

Suffice it to say that, when the cord 36 and plug 42 (FIG. 1) are plugged into a conventional wall or like receptacle, electric power is controlled by the on-off switch 38 and is selectively supplied to the lamp 28 to light the fluorescent tube 30. The interior surfaces of the housing 16 are preferably painted or otherwise rendered light-reflective so that the light from the tube 30 is in major part directed to and through the translucent wall or member 12.

Now, it should be noted that the center of gravity of the light box 10 (in large part because of the transformer 34 being secured to the bottom wall 24), is near the bottom wall 24. This is done deliberately and cooperates with the placement of support legs to allow the light box 10 to be mounted on a flat surface such as a counter top, as shown in FIGS. 2 and 4, with less risk of it tipping over.

As is best shown in FIGS. 2 and 3, hanging loops 60, 62 and 64 are secured to brackets 66, 68 and 70 which are in turn pivotally secured to the back wall 18 by rivets 72, 74 and 76. These loops 60, 62 and 64 allow the light box 10 to be hung from a wall or other vertical surface either in landscape orientation as shown in FIG. 1, or by loops 62 and 64 in the portrait orientation. When not in use the brackets and loops can be pivoted to the positions shown in FIG. 2 wherein they are out of the way.

In accordance with the present invention, the outer surface of the rear wall 18 is provided with shallow flat depressions 80 and 90 each opening to the sidewall and receiving a pivotable flat leg 82 or 92. The shallow depressions 80 and 90 define a storage area for the legs with leg 92 being shown in its storage position in FIG. 3 and leg 82 in its storage position in FIG. 2. The legs 82, 92 are made of a stiff but relatively bendable material (such as plastic). The operational position of the leg 92 is shown in FIGS. 2 and 4 and that of leg 82 in FIG. 3. In each case the legs 82, 92 are pivotally secured to the wall 18 by rivets 84, 94.

The leg 82 is prevented from pivoting out of its operational position (FIG. 2) by the side edge surfaces 86, 88 of the shallow depression 80 and the leg 92 is similarly restrained in its operational position (FIG. 3) by the side edge surfaces 96, 98 of the depression 90.

Figure 5:
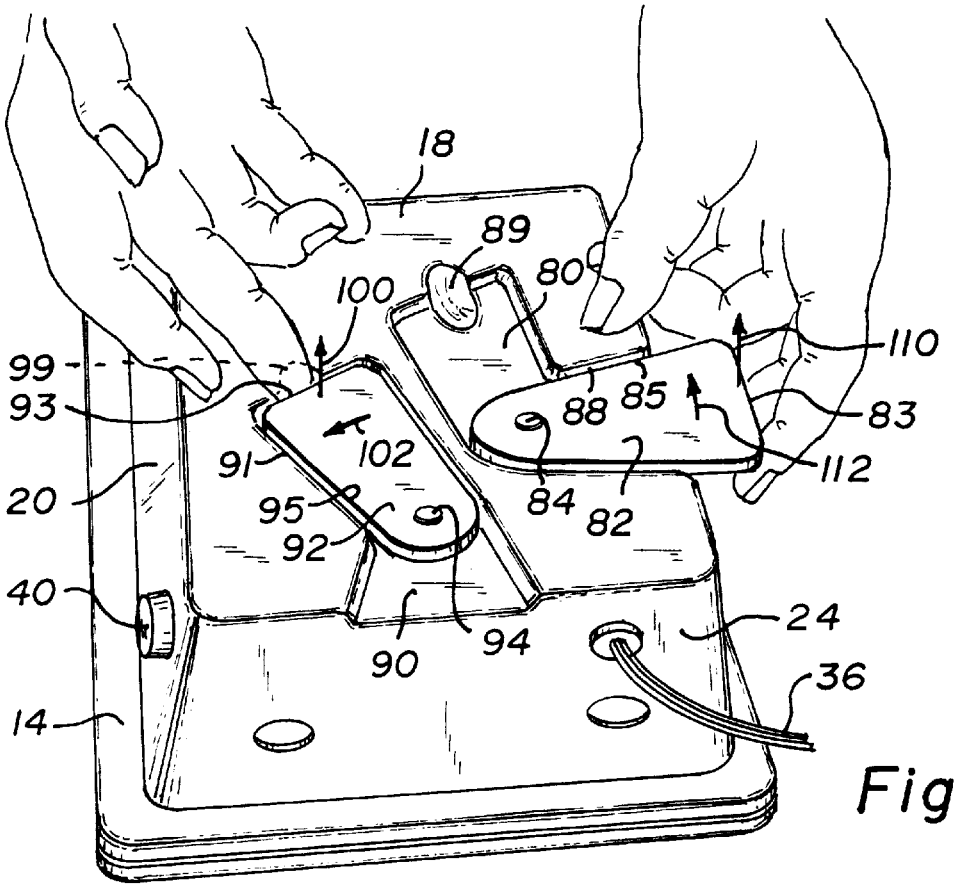
FIGS. 5–7 are perspective views of the rear of the light box of FIGS. 1–4 with the hands of a user illustrating the operation of an inventive feature of the invention.
Figure 6:
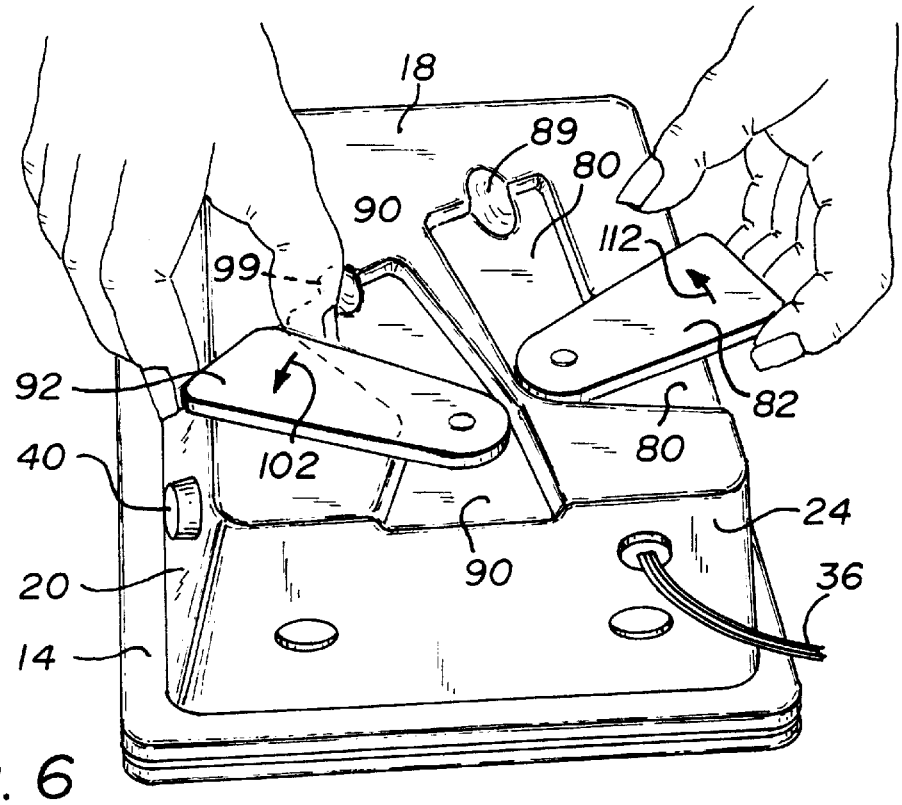
Figure 7:
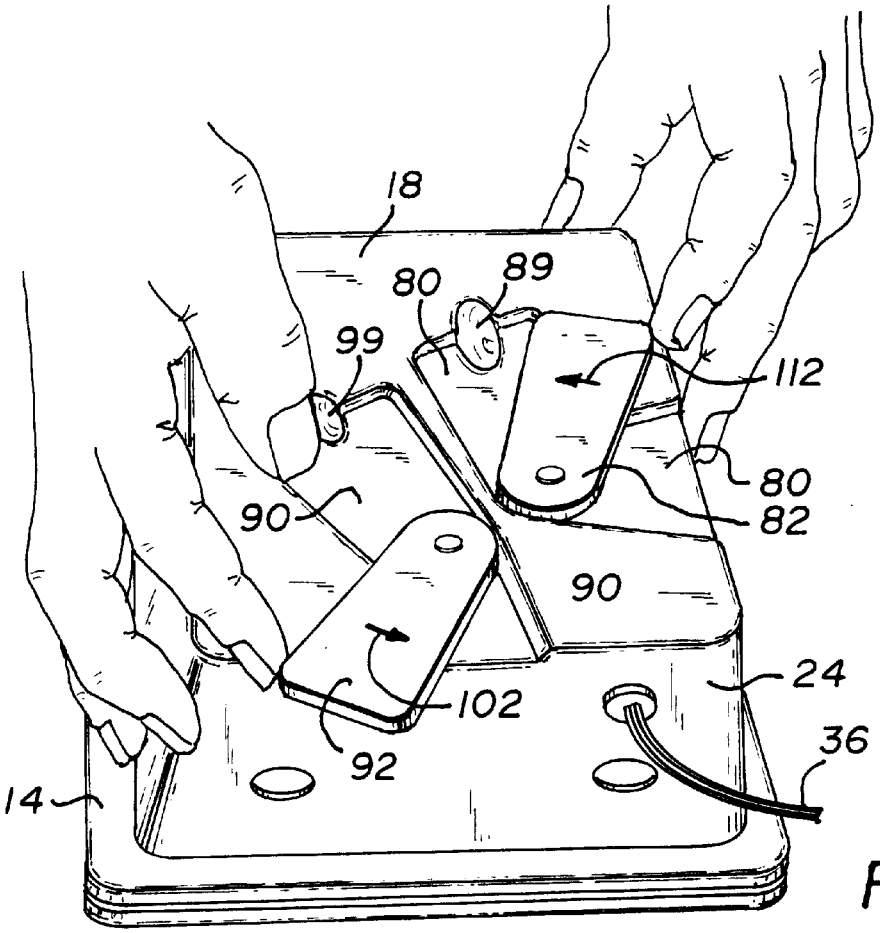

Each of the depressions 80, 90 also feature an extra deep area or finger holes or depressions 89, 99 which, as illustrated in FIG. 5, aids the user in operating the legs. Referring to FIG. 5, a user can move the leg 92 from its stored position inboard of the side wall 24 by inserting a finger into the depression 99 under the outermost edge 93 of the leg 92 and flexing it upward in the direction of the arrow 100 and pivoting the leg 92 in the direction of the arrow 102. This causes its side edge 95 to ride up and over the edge 91 of the depression 90 as shown in FIG. 6. By continuing to pivotally rotate the leg 92 as shown in FIG. 7 the leg 92 is caused to "snap" into the operational position shown in FIG. 8.

Figure 8:
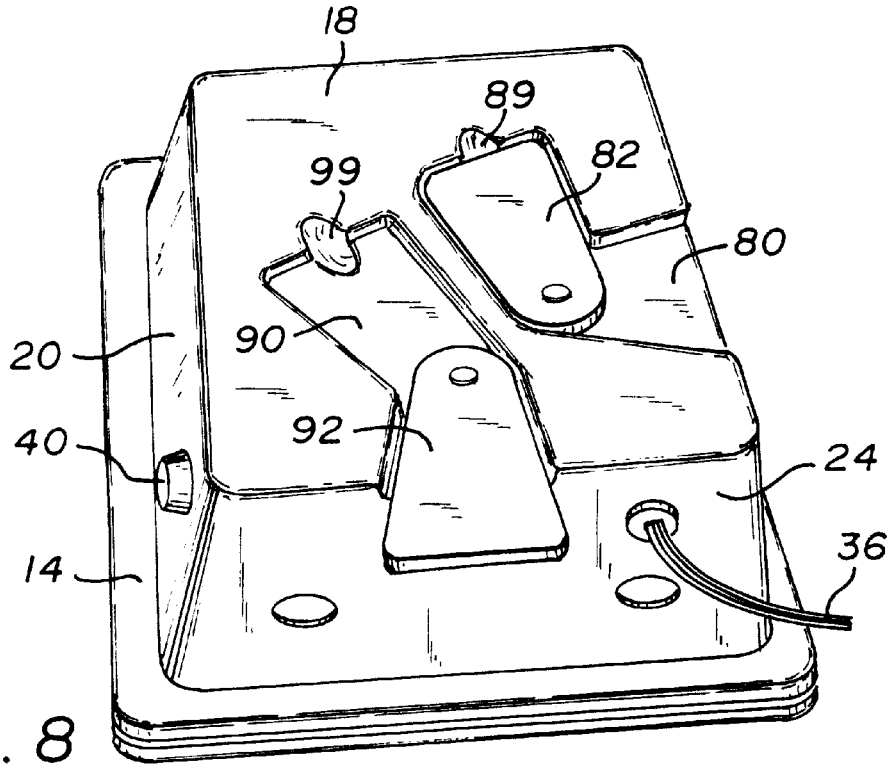
FIG. 8 is a perspective view similar to that of FIGS. 5–7 showing the light box of FIGS. 1–7 with parts in a moved further position from that of FIG. 7.

The leg 82 can be removed from its operational position shown in FIG. 5 by bending it upward from its outermost edge 83 as indicated by the arrow 110 and pivoting it in the direction indicated by the arrow 112 so that the side edge 85 rises up and over the depression edge 88 as illustrated in FIG. 6. And by continuing to pivot the leg 82 as shown in FIG. 7 until the leg 82 is caused to "snap" into its storage position as shown in FIG. 8.

Of course, the leg 82 can be moved to its operational position in the same manner as illustrated and explained with respect to the leg 82 in FIGS. 5–8 and the leg 92 can be moved to its storage position in the same manner as was illustrated and explained above in association with FIGS. 5–8 and with regard to leg 92.

Several prototypes of the inventive light box have been constructed and tested and shown to work well. One prototype had an overall dimension of about 9½ by 11 by 4½ inches with a translucent surface or wall 12 of about 7¼ by 9½ inches. The translucent surface was formed of a sheet of clear PETG plastic made by Primex approximately 8 by 10 by 0.30 inches thick, sandwiched over a similarly sized sheet of translucent white polystyrene made by Primex. The housing, including the back walls and side walls, was made by vacuum forming a sheet of ABS plastic made by Allen Extruders which sheet was apparently 0.09 inch in thickness. The depressions 80 and 90 were generally apparently ¼ inch deep, but with the finger hole depressions 89 and 99 being about ½ inch deep. The legs 82 and 92 were made of about 3/16 inch thick ABS plastic manufactured by Allen Extruders. The legs were approximately 2 inches at the widest and 3½ inches long and were pop riveted at about 2 and 13/16 inches from the support edge. The depression had a width of about 2 inches at the edge of the rear wall and the legs had a width of about 1¾ inch at that location.

While one particular embodiment of the invention have been shown and described, it will be obvious to those in the art that changes and modifications may be made without departing from the invention and, therefore, the aim in the appended claims is to cover all such changes and modifications as fall within the true spirit and scope of the invention.

I claim:

1. A light box comprising:

a housing having a generally flat rear wall, said wall having an outer periphery edge;

a front wall having an edge and a translucent panel through which light can pass;

side walls extending from the periphery edge of the flat rear wall to the edges of said front wall;

a light source mounted inside the housing, said source being controlled to selectively provide light to said translucent panel, the improvement comprising a flat, generally, planar leg:

a shallow depression in the outer surface of said rear wall shaped to receive said flat leg in a storage position with a loose fit between the longitudinal edges of the depression or in an operational position wherein the leg projects outward from the edge of the rear wall in substantially the same plane as the rear wall;

said leg sized to fit into said shallow depression in said rear wall and pivotally secured to said wall to rotate between said operational position and said storage position, said leg being resiliently flexible so as to be able to bend sufficiently under a normal force to clear undepressed areas of said rear wall when pivoting between said storage and operational positions, but to move back into the depression upon reaching said depression in the absence of a normal bending force.

2. A light box comprising:

a frame;

a rear wall to said frame, said real wall defining at least one shallow depression extending from a wall outer edge to an interior area of the wall;

a flat leg pivotally secured to said wall within said depression, said leg being flexible and capable of flexibly bending so as to move from a storage position within said depression over a raised portion of the wall and resiliently return to said depression when released thereover in an operation position, whereby the leg projects outward from the edge of the wall.

3. The light box of claim 1, wherein said shallow depression of said rear wall including a finger-tip receiving depression which allows the tip of a finger of a user to reach under an edge of said leg when said leg is in said storage position for lifting and leading said leg outward.

4. The light box of claim 1, wherein said rear wall includes two said depressions and each depression having said leg therein.

5. The light box of claim 4 wherein, the operational position of one of said legs is at approximately a right angle to the operational position of the other of said legs.

6. The of claim 4 wherein said front wall is of a generally rectangular shape and one of said legs in its operational position can help support the light box on a flat surface with the front wall orientated in a generally vertical plane and in the positional orientation and said other leg in its operational position can help support the light box on a flat surface with the front wall orientated in a generally vertical plane and in the landscape orientation.

7. The light box of claim 4 wherein each of said shallow depression of said rear wall including a finger-tip receiving depression which allows the tip of a finger of a user to reach under the edge of said leg when said leg is in its storage position for lifting and leading said leg outward.

* * * * *